US006253723B1

(12) United States Patent
Edlund et al.

(10) Patent No.: US 6,253,723 B1
(45) Date of Patent: Jul. 3, 2001

(54) AUTOMATIC DECOMPRESSION VALVE FOR AN INTERNAL COMBUSTION ENGINE

(75) Inventors: Dag Edlund, Huskvarna; Thomas Engman, Mullsjö, both of (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/411,739

(22) Filed: Oct. 1, 1999

(30) Foreign Application Priority Data

Oct. 29, 1998 (SE) ..... 9803714

(51) Int. Cl.[7] ..... F02B 67/10
(52) U.S. Cl. ..... 123/182.1
(58) Field of Search ..... 123/182.1

(56) References Cited

U.S. PATENT DOCUMENTS 3,638,632 * 2/1972 Boling ..... 123/182.1
3,704,988 * 12/1972 Steele ..... 123/182.1
3,782,354 * 1/1974 Tuckey ..... 123/182.1
3,893,440 * 7/1975 Dooley ..... 123/182.1
3,919,991 * 11/1975 Neschke et al. ..... 123/182.1
4,619,228 * 10/1986 Liu ..... 123/182.1
5,007,391 * 4/1991 Nomoto ..... 123/182.1
5,050,546 * 9/1991 Nomoto ..... 123/182.1
5,211,140 * 5/1993 Hironaka ..... 123/182.1

* cited by examiner

*Primary Examiner*—Willis R. Wolfe
*Assistant Examiner*—Arnold Castro
(74) *Attorney, Agent, or Firm*—Pearne & Gordon LLP

(57) ABSTRACT

An automatic valve for reducing compression in order to facilitate starting of a two-stroke internal combustion engine includes a movable valve (25) adapted to control a gas flow through an opening (16) provided in a wall of the combustion chamber of the engine. A spring (27) is adapted to move the movable valve (25) to an open position, and a drive actuated by an underpressure is adapted to move the movable valve (25) to a closed position against the action of the spring (27). The driver includes a cylinder (18), a piston (19) movable in the cylinder (18) and connected to the movable valve (25), and a conduit (22) connecting the cylinder (18) to a source of underpressure. A one-way valve (23) is provided in the conduit (22) for allowing an air flow in a direction a way from the (18) only, and a leak passage (30) is adapted to allow a small flow of air into the (18) for facilitating the opening of the movable valve (25) when operation of the engine has been stopped.

6 Claims, 1 Drawing Sheet

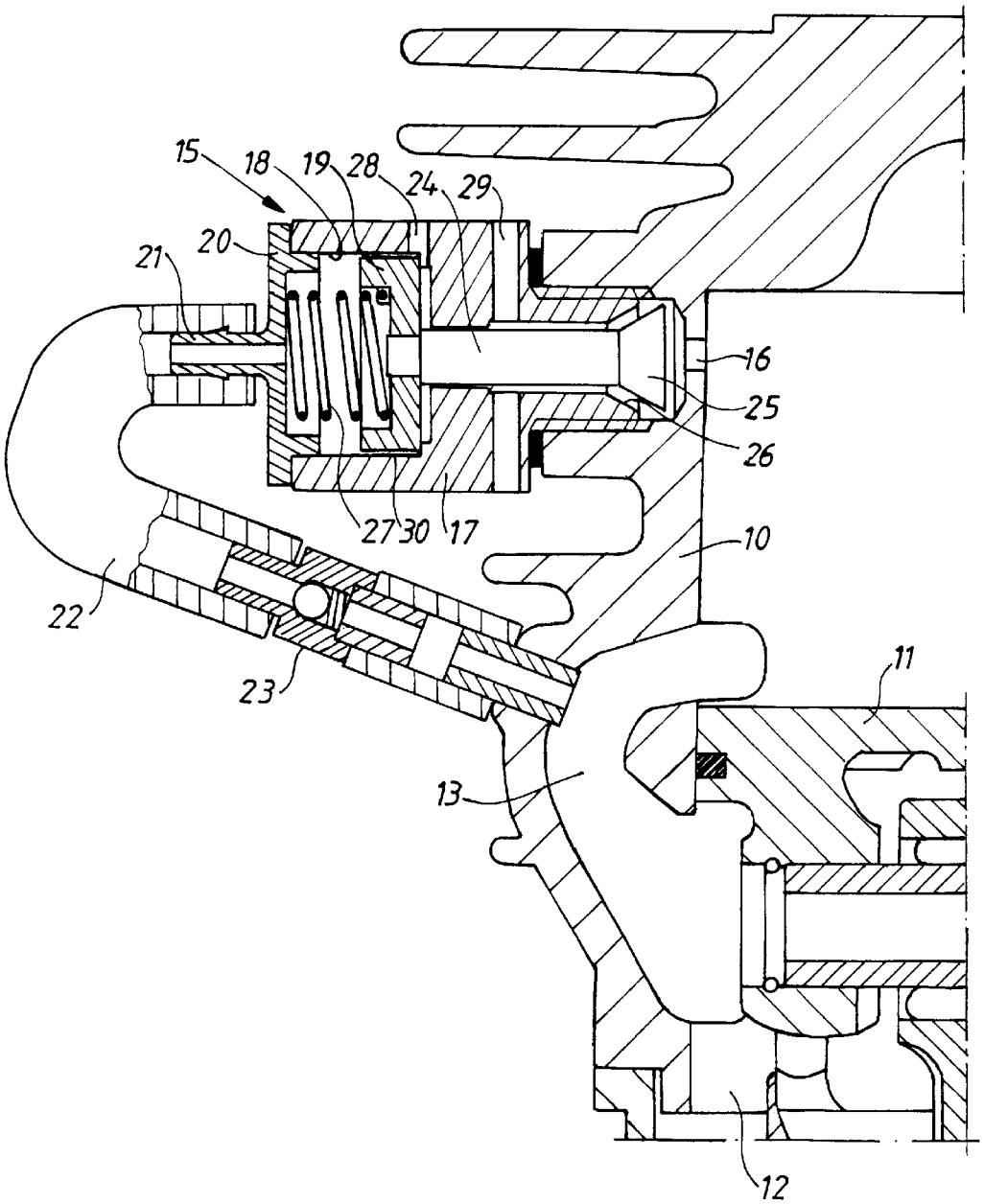
15
18
19
28
24
29
20
21
16
25
26
27
30
17
10
22
23
11
13
12

AUTOMATIC DECOMPRESSION VALVE FOR AN INTERNAL COMBUSTION ENGINE

BACKGROUND OF THE INVENTION

The present invention relates to an automatic valve for reducing compression during start of a two-stroke internal combustion engine, comprising a movable valve adapted to control a gas flow through an opening in a wall of the combustion chamber of the engine, a resilient means for moving the movable valve to an open position, and a driver actuated by an underpressure and adapted to move the movable valve to a closed position against the action of the resilient means.

The decompression valve according to the invention has the purpose of facilitating the starting of internal combustion engines of the type started either manually by means of a rope starter or the like, or by an electric starter motor. For the intended purpose, a plurality of valve designs adapted to automatic operation have been previously proposed. Such prior art valves are disclosed in, for example, DE 1949541, U.S. Pat. No. 5,050,546 and DE 4403609. It has appeared, however, that the prior art valves known from these publications do not operate satisfactorily and, as far as is known, have therefore not been used in practice.

SUMMARY OF THE INVENTION

It is an object of the present invention to avoid the problems and disadvantages encountered in connection with prior art valve designs and to provide an automatic decompression valve having a good reliability and operability in practical use. The present invention achieves this result by means of a decompression valve of the kind mentioned in the introduction in which the driver includes a cylinder, a piston is movable in the cylinder and connected to the movable valve, a conduit connects the cylinder to a source of underpressure, a one-way valve provided in the conduit for allowing an air flow in a direction a way from the cylinder only, and a leak passage is adapted to allow a small flow of atmospheric air into said cylinder for facilitating opening of the movable valve when the operation of the engine has been stopped.

BRIEF DESCRIPTION OF THE DRAWING

The invention will be described in more detail in the following with reference to the accompanying drawing which illustrates a partial section of a two-stroke internal combustion engine incorporating a decompression valve according to a preferred embodiment of the present invention.

DETAILED DESCRIPTION OF THE PREFERRED EMBODIMENT

The drawing illustrates a portion of an engine cylinder 10 having a piston 11 movable therein. A crankcase 12 is provided under the piston 11 and is connected, via a scavenging passage 13 to the interior of the cylinder 10 when the piston is at a bottom position, as illustrated.

A decompression valve 15 is provided in the wall of the engine cylinder 10 and is connected to the interior of the cylinder 10 via a bore 16 in the cylinder wall. The decompression valve 15 comprises a housing 17 that dentines a cylinder 18 having a piston 19 movable therein. The housing 17 has an end wall 20 provided with a nipple 21 which is connected to the crankcase 12 of the engine via a conduit 22 and the scavenging passage 13. The conduit 22 has a one-way valve 23 therein. The one way valve 23 permits airflow in a direction from the decompression valve 15 toward the crankcase 12 and prevents air flow from the crankcase 12 toward the decompression valve 15.

The piston 19 is connected by means of a bar 24 to a valve means 25 cooperating with a valve seat 26. The valve cylinder 18 has a pressure spring 27 therein resiliently actuating the piston 19 to be moved to the right in the drawings so as to bring the valve means 25 to assume an open position. The right end of the cylinder 18 is connected to the atmosphere via a bore 28 in the cylinder wall, thereby ensuring that atmospheric pressure will always be present on the right hand side of the piston 19.

In the drawing, the valve means 25 is shown in the open position, whereby gases from the engine cylinder may pass the valve means 25 and be discharged to atmosphere via a number of bores 29 annularly spaced around the valve housing 17. The openings 29 may be connected via a passage (not shown) to the right end of the cylinder 18, whereby the bore 28 may be omitted. The valve means 25 is held in the open position by the spring 27. When the engine is rotated in order to be started, the compression in the engine cylinder 10 will therefore be substantially less than normal which essentially reduces the power required for rotation of the engine. When the engine starts, an underpressure is created in the crankcase 12 and this underpressure actuates the piston 19 via the conduit 22 so as to move the piston 19 to the left in the drawing against the action of the spring 27, whereby the movable valve 25 will be closed by sealing against the valve seat 26.

In operation, of the engine an overpressure will be created alternately in the crankcase 12, namely during the phase in which the air/fuel mixture is compressed by the downward movement of the piston 11. As the one-way valve 23 is closed in this phase, actuation of the decompression valve 15 by the overpressure is prevented, and the valve means 25 remains in the closed position. When the engine is running, the combustion pressure in the engine cylinder 10 also contributes to maintaining the valve means 25 in the closed position.

When the engine has stopped, the valve means 25 is opened by the spring 27. It is important that the opening takes place without any essential delay in order to, if required, facilitate immediate restart of the engine. The underpressure in the valve cylinder 18 must therefore be rapidly restored to atmospheric pressure, and to this end the piston 19 has a small gap 30 allowing a controlled flow of atmospheric air to pass the piston 19. The air flow is preferably adapted so as to open the valve means 25 within a preferred, short period of time, for example 1–2 seconds after the engine has stopped. Instead of the gap 30 a corresponding leak opening allowing a controlled entry of atmospheric air can be provided in the conduit 22 between the valve cylinder 18 and the one-way valve 23.

In the embodiment described above, the conduit 22 is connected to the crankcase of the engine. It is within the framework of the invention, however, to use any other source of underpressure, such as the carburetor of the engine, or the intake tube between the carburetor and the engine.

What is claimed is:

1. An automatic valve for reducing compression during start of a two-stroke internal combustion engine, comprising a movable valve (25) adapted to control a gas flow through an opening (16) in a wall of the combustion chamber of the engine, a resilient means (27) for moving said movable valve (25) to an open position, and a driver actuated by an underpressure and adapted to move said movable valve (25) to a closed position against the action of said resilient means (27), wherein the driver comprises a cylinder (18) and a piston (19), said piston being movable in said cylinder (18) and connected to said movable valve (25), a conduit (22) connects said cylinder (18) to a source of underpressure, a one-way valve (23) is provided in said conduit (22) for allowing air flow in a direction away from said cylinder (18) and for preventing air flow in a direction toward said cylinder, and a leak passage (30) adapted to allow a small flow of atmospheric air into said cylinder (18) to facilitate opening of said movable valve (25) when the operation of the engine has been stopped.

2. The automatic valve according to claim 1, wherein a crankcase of the engine is the source of underpressure, and the cylinder (18) is connected to the crankcase (12) by the conduit (22).

3. The automatic valve according to claim 1, wherein the cylinder (18) is connected to an intake tube of the engine.

4. The automatic valve according to claim 1, wherein the leak passage (30) is adapted to allow a controlled air flow to pass the piston (19).

5. The automatic valve according to claim 2, wherein the leak passage (30) is adapted to allow a controlled air flow to pass the piston (19).

6. The automatic valve according to claim 3, wherein the leak passage (30) is adapted to allow a controlled air flow to pass the piston (19).

* * * * *